US005206452A

United States Patent [19]

Stamper et al.

[11] Patent Number: 5,206,452

[45] Date of Patent: Apr. 27, 1993

[54] DISTRIBUTED WEAPON LAUNCH SYSTEM

[75] Inventors: Ralph H. Stamper; Deborah Norman, both of Stevenage, Great Britain

[73] Assignee: British Aerospace Public Limited Company, London, England

[21] Appl. No.: 820,035

[22] Filed: Jan. 14, 1992

[30] Foreign Application Priority Data

Jan. 14, 1991 [GB] United Kingdom ..... 9100731

[51] Int. Cl.[5] ..... G06G 15/00; F41A 13/00

[52] U.S. Cl. ..... 89/1.11; 42/84; 244/3.14

[58] Field of Search ..... 89/1.11, 1.1, 28.05, 89/28.1, 28.2; 42/84; 244/3.14, 3.11

[56] References Cited

U.S. PATENT DOCUMENTS

| | | | |
|---|---|---|---|
| 2,399,426 | 4/1946 | Bradley | 89/28.2 |
| 4,093,153 | 6/1978 | Bardash et al. | 244/3.14 |
| 4,205,589 | 6/1980 | Engler et al. | 42/84 |
| 4,256,013 | 3/1981 | Quitadama | 42/84 |
| 4,267,562 | 5/1981 | Raimondi | 89/1.11 |
| 4,848,208 | 7/1989 | Kosman | 89/1.11 |
| 5,046,006 | 9/1991 | Revord et al. | 89/1.11 |

*Primary Examiner*—David H. Brown

*Attorney, Agent, or Firm*—Cushman, Darby & Cushman

[57] ABSTRACT

A battery of dispersed missile launch stations (1–4) are linked to a central communications station (5) which assigns different targets to respective launch stations. The communications station ensures that only one launch station engages each target.

15 Claims, 2 Drawing Sheets

START
ENGAGE TARGET
10
TRANSMIT TARGET DATA FROM FIRE UNIT TO COMMUNICATIONS STATION
12
RECEIVE TARGET DATA AT COMMUNICATIONS STATION, TRANSMIT TO OTHER FIRE UNITS
14
RECEIVE TARGET DATA AT OTHER FIRE UNITS
16
ESTABLISH TRACK WINDOW
20
TARGET DATA IN WINDOW?
22
N
Y
ASSIGN LOW THREAT TO TARGET
24
OTHER TARGET AVAILABLE?
26
28
Y
N
30
ENGAGE OTHER TARGET
PROHIBIT
END

DISTRIBUTED WEAPON LAUNCH SYSTEM

BACKGROUND OF INVENTION

This invention relates to the control of a battery of weapons such as missile launch stations (fire units).

DESCRIPTION OF THE PRIOR ART

A battery of dispersed missile launch stations, sometimes called fire units, may be linked to a central command station which, for example, assigns different targets to respective fire units. Without this control, several fire units might engage the same target while other targets go unmolested. Conceptually, the known arrangements have the control station as the hub of a radial array of fire units each with a respective communications link to the "hub". Thus, information such as target position and rate always goes from the fire units to the control station and the assignment decisions are then sent out from the control station to the fire units. As a result, the response time may be too great, especially in a very demanding scenario such as that of a battery of ground to air missile launchers deployed to protect an installation which may be attacked by several or even many enemy aircraft at the same time.

BRIEF SUMMARY OF THE INVENTION

The object of the invention is to provide a system with improved response times.

To realize the above object, the invention is directed to a distributed weapons system comprising a central communications station, a plurality of weapon launch stations, a communications link between each weapon launch station and the central communications station. Each of the weapon launch stations includes means for engaging a first target, means for transmitting data relating to the location of the first target to another weapon launch station via the central communications station, means for receiving data relating to the location of a second target from another weapon launch station via the central communications station, and means for inhibiting engagement of the second target.

Hence, certain significant control functions are executed at each fire unit rather than relying entirely on the central control station. Conceptually, the control system then begins to have a mesh configuration, although the actual communication between fire units may still rely on respective links between the fire units and the control station. The difference is that the control station now only re-transmits information passed to it.

BRIEF DESCRIPTION OF THE DRAWING

Reference will now be made by way of example to the accompanying drawings, in which.

DETAILED DESCRIPTION OF THE PREFERRED EMBODIMENTS

Figure 1:
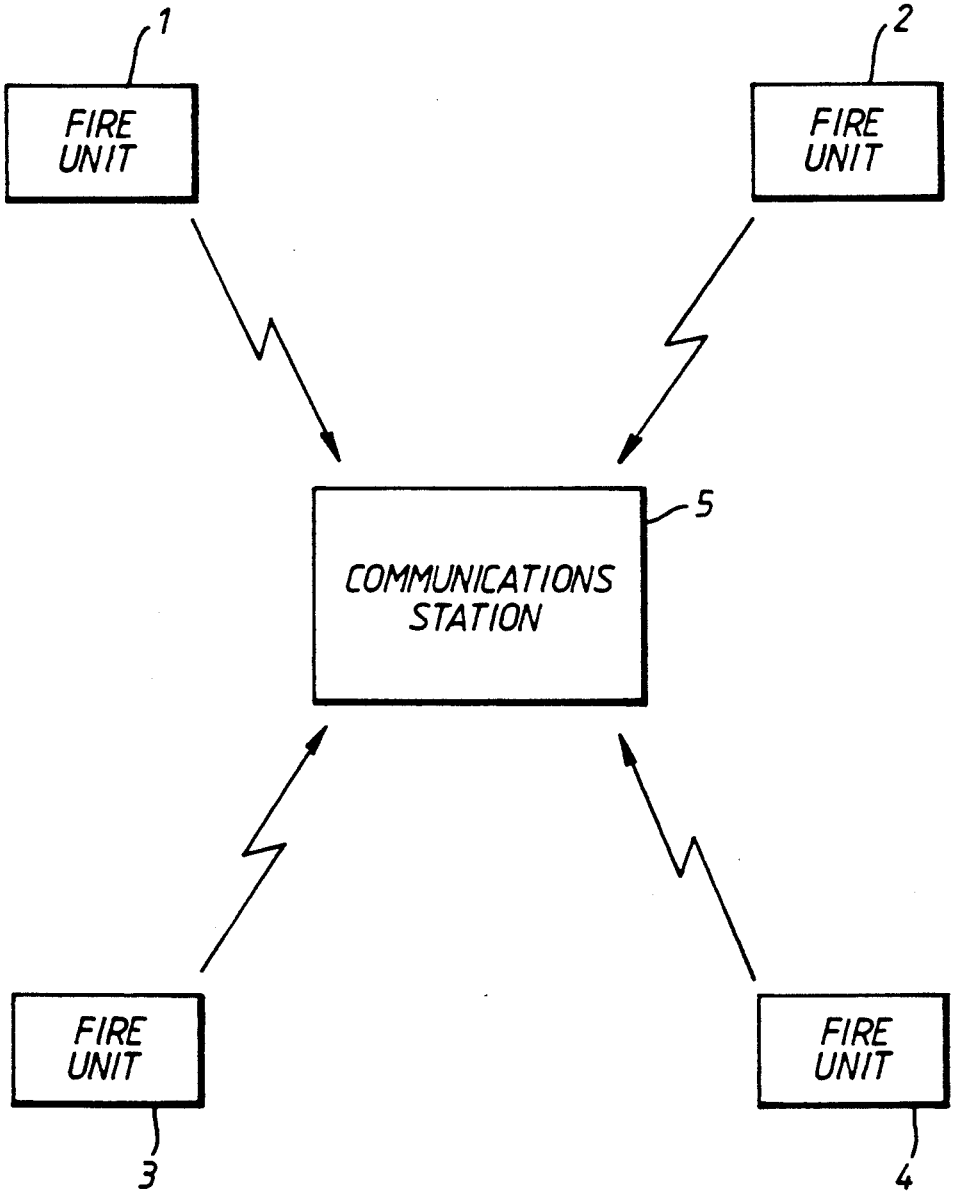
FIG. 1 is a simplified diagram of a battery of four fire units arranged around a central communications station.
Figure 2:
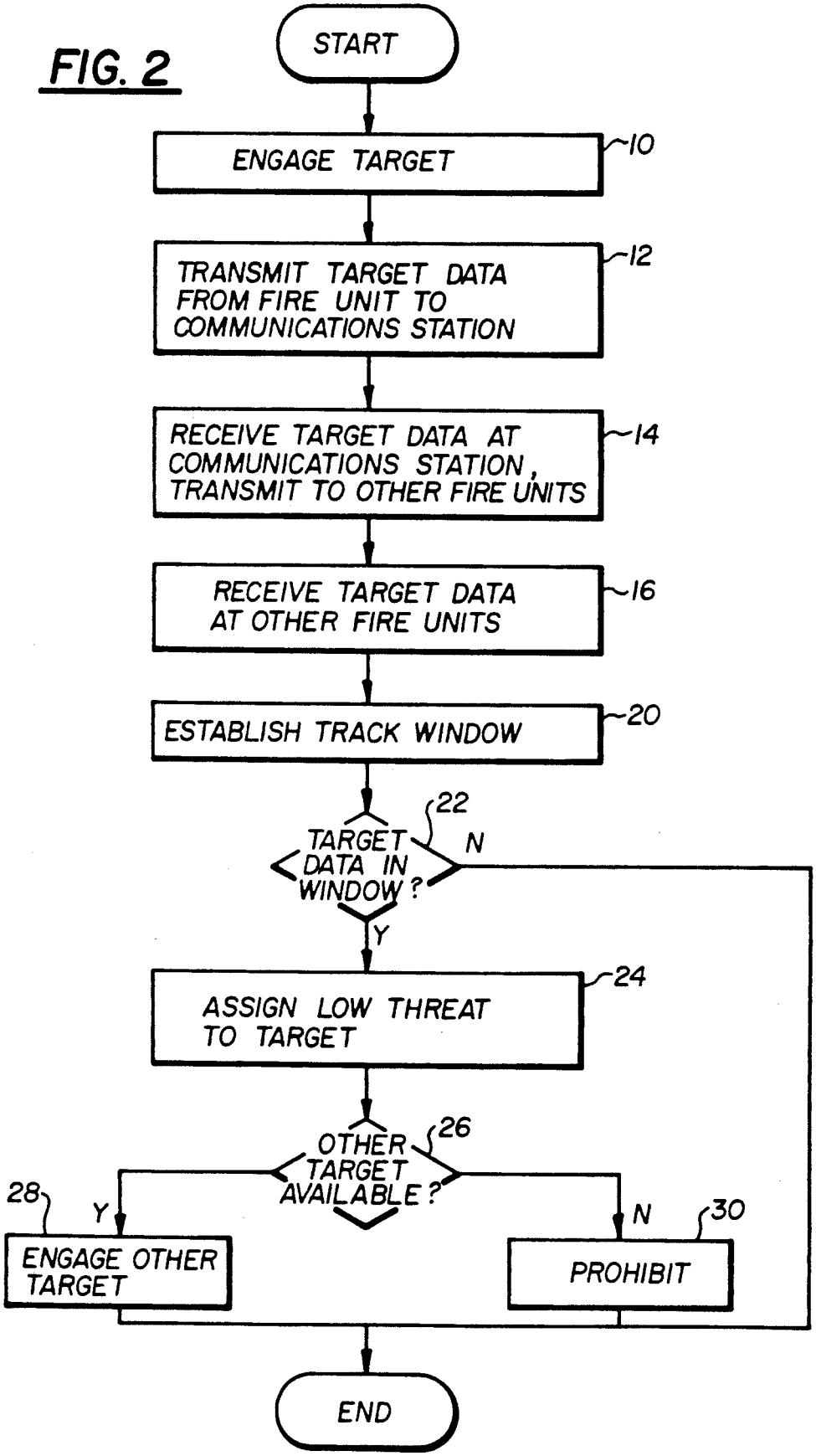
FIG. 2 is a flowchart illustrating the operation of the system.

In FIG. 1 the four fire units 1 to 4 are each linked to a central communications station 5 by any suitable data transmission means, for example, by optical or electrical cable or by some form of wireless transmission link. Each fire unit transmits to the communications station 5 data concerning the position and rate of targets which it is presently tracking (FIG. 2, steps 10, 12). This data is immediately retransmitted, i.e., broadcast by the communications station 5 to all the other fire units 1–4 (Fig.2, steps 14, 16). The communications station 5 also broadcasts data request signals to the fire units (1–4).

Each fire unit (1–4) comprises a computerized control system which incorporates a target sensor and tracker and which can respond to information passed to it to "lock out" particular targets which it might otherwise have engaged. The first sensor to see a particular target makes this known to the other fire units (1–4) which are then locked out from engaging that target although they continue to "see", i.e., track it. This action is subject to an overall control algorithm to be described later. The computing inherent in the control algorithm is done at the fire units (1–4) themselves. The central communications station 5 remains as a "dumb" element which serves only to re-transmit the information supplied by the fire units (1–4).

Note that if a target enters the viewing area of a particular fire unit while another fire unit (1–4) which has seen it previously is still trying to engage it, that engagement continues. In the following, it is assumed that any one fire unit only causes the other units to lock out one target but this need not be the case—if each fire unit has the capability for tracking and engaging two targets at once, then corresponding, the algorithm could be modified so that those targets become locked out from the other fire units.

In addition, the system may incorporate anti-anti-radiation missile features such as a sequential switch off of the target trackers. Then, to handle targets which appear while the system is partly switched off, the trackers of the fire units which are on can be given a degree of authority over those units which are switched off.

Referring now to the overall control algorithm, its tasks include:

a. prevention of the fire units (1–4) from engaging a target which is being engaged by another unit in the battery;
b. enhancement of the performance, i.e., kill probabilities, of the battery against large numbers of targets;
c. the provision of information to a fire unit in the event that its surveillance sensor is incapacitated;
d. improvement, of the battery performance when operating in the presence of electronic countermeasures; and
e. avoidance of performance degradation at each unit when the algorithm cannot be applied.

The algorithm is performed as an element of a target management system.

When a target is detected, its track is predicted in a conventional manner and, if found to lead to a protected area, and "in cover", that is within missile intercept range then its "threat" value is, deduced and compared with other targets already in the threat table (FIG. 2, steps 20, 22). The highest threat is "Allocated" to the fire unit trackers which then acquire the target. Shortly after lock on, a missile is launched by an operator.

When a target is allocated and tracked by a fire unit 1 (FIG. 2, step 10), the following information is provided to the communication station 5:

a. Target Track;
b. A FIRE UNIT STATUS flag; and
c. A TARGET STATUS flag.

The communication station 5 transmits this information to all other fire units 2, 3, 4 (FIG. 2, steps 12, 14). When received the fire units (2,3,4) will take the data and do the following with it:

a. STORE AND TAG THE TRACK;

b. put a "window" around the TRACK data to encompass all predictable errors (FIG. 2, step 20);

c. compare target data in the threat tables with the "windowed" target (FIG. 2, step 22);

d. any target that fits into the window is given a low threat level, depending upon the FIRE UNIT STATUS and TARGET STATUS flags (FIG. 2, step 24); and e. if the target is being tracked by a receiver fire unit 1 then either:

i. firing of a missile will be prohibited (FIG. 2, step 30); or ii. if there is another threat, the tracker will be unlocked and slewed to engage it (FIG. 2, step 28).

Setting a low threat value ensures that if there are other targets available the receiver fire unit will engage them, but if this is the only target then the receiver fire unit will commence engagement of it. The level at which the engagement is arrested depends upon the FIRE UNIT STATUS FLAG and the TARGET STATUS FLAG.

For the given example, the target co-ordinates must be Cartesian, the same as those used in geographical alignment. They are Northings, Eastings, and altitude.

The FIRE UNIT STATUS flag indicates EITHER TRACKING or MISSILE FIRED.

The TARGET STATUS flag indicates:

a. IN COVER, APPROACH; or b. IN COVER, RECEDE; or c. OUT OF COVER.

The response to the FIRE UNIT STATUS flag is as follows:

a. IF FLAG=MISSILE FIRED, then PROHIBIT FIRING AT THE WINDOWED TARGET by receiver fire unit; and b. IF FLAG=TRACKING, then use this flag in conjunction with TARGET STATUS FLAG.

The response to the TARGET STATUS flag is as follows:

a. IF FIRE UNIT STATUS FLAG=TRACKING, then;

b. IF TARGET STATUS FLAG=INCOVER/APPROACH then set THREAT VALUE to MINIMUM. PROHIBIT FIRING AGAINST THE WINDOWED TARGET, by receiver fire unit;

c. IF TARGET STATUS FLAG=INCOVER/-RECEDE then set THREAT VALUE TO NORMAL;

d. PROHIBIT FIRING AGAINST THE WINDOW TARGET BY receiver fire unit; and e. IF TARGET STATUS FLAG=OUT OF COVER, then set THREAT to NORMAL, REMOVE FIRING INHIBIT.

I claim:

1. A distributed weapon system comprising:

a central communications station;

a plurality of weapon launch stations;

a communications link between each weapon launch station and the central communications station;

and in which each weapon launch station includes (i) means for engaging a first target, (ii) means for transmitting data relating to the location of the first target to another weapon launch station via the central communications station, (iii) means for receiving from another weapon launch station via the central communications station data relating to the location of a second target, and (iv) means for inhibiting engagement of the second target.

2. The system of claim 1, said receiving means comprising: means for receiving a target track;

means for establishing a window around said track to compensate for predictable errors; and means for comparing said windowed track to target data in threat tables.

3. The system of claim 2, said inhibiting means comprising:

means for assigning a low threat level to any target represented by target data in said threat table which falls within said windowed track;

means for determining whether a different target is available;

means for engaging said different target when said determination means determines that said different target is available; and means for prohibiting firing of a missile at said target represented by target data in said table when said determining means determines that no different target is available.

4. The system of claim 1, wherein said first and second target data comprise tracking data on the position and rate of travel of said first and second targets, respectively.

5. The system of claim 4, wherein said tracking data comprises a target track, a fire unit status flag, and a target status flag.

6. A distributed weapon system comprising:

a first weapon launch station including means for engaging a target and means for transmitting data relating to the location of the target to a central communications station;

wherein said central communications station includes means for receiving said first data and means for transmitting said first data to a second weapon launch station;

wherein said second launch station includes means for receiving said data and means responsive to said data for inhibiting engagement of the target.

7. The system of claim 6, said receiving means comprising:

means for receiving a target track;

means for establishing a window around said track to compensate for predictable errors; and means for comparing said windowed track to target data in threat tables.

8. The system of claim 6, said inhibiting means comprising:

means for assigning a low threat level to any target represented by target data in said table which falls within said windowed track;

means for determining whether a different target is available;

means for engaging said different target when said determination means determines that said different target is available; and means for prohibiting firing of a missile at said target represented by target data in said table by said second weapon launch station when said determining means determines that no different target is available.

9. The system of claim 6, wherein said data comprises tracking data on the position and rate of travel of targets currently tracked by said plurality of weapon launch stations.

10. The system of claim 9, wherein said tracking data comprises a target track, a fire unit status flag, and a target status flag.

11. A method of controlling weapons in a distributed weapon system comprising the steps of:

engaging a target with a first weapon launch station;

transmitting data relating to the location of the target to a central communications station;

receiving said data at said central communications station;

transmitting said data from said central communications station to a second weapon launch station;

receiving said data at said second launch station; and inhibiting engagement of the target by said second launch station responsive to said received data.

12. The method of claim 11, said second launch station data receiving step comprising the steps of:

receiving a target track;

establishing a window around said track to compensate for predictable errors; and comparing said windowed track to target data in threat tables.

13. The method of claim 11, said inhibiting step comprising the steps of:

assigning a low threat level to any target represented by target data in said table which falls within said windowed track;

determining whether a different target is available;

engaging said different target when said determination step determines that said different target is available; and prohibiting firing of a missile at said target represented by target data in said table by said second weapon launch station when said determining step determines that no different target is available.

14. The method of claim 11, wherein at least one of said first weapon launch station data transmitting step, said central communications station data receiving step, said central communications station data transmitting step and said second weapon launch station data receiving step comprises a step of conveying tracking data on the position and rate of travel of targets currently tracked by said weapon launch stations.

15. The method of claim 11, wherein said conveying step comprises the steps of:

conveying target track data;

conveying a fire unit status flag; and conveying a target status flag.

* * * * *